US005885159A

United States Patent [19]

DeAngelis

[11] Patent Number: 5,885,159

[45] Date of Patent: Mar. 23, 1999

[54] SYSTEM FOR, AND METHOD OF, CONTROLLING THE OPERATION OF TOYS

[75] Inventor: Peter C. DeAngelis, Carlsbad, Calif.

[73] Assignee: Rokenbok Toy Company, Cardiff, Calif.

[21] Appl. No.: 696,263

[22] Filed: Aug. 13, 1996

[51] Int. Cl.[6] ..... A63F 17/39

[52] U.S. Cl. ..... 463/39; 463/62; 446/454; 446/456

[58] Field of Search ..... 463/40, 62, 63, 463/6; 446/454, 456, 457, 470, 465, 431, 436, 441

[56] References Cited

U.S. PATENT DOCUMENTS

| | | | |
|---|---|---|---|
| 3,303,821 | 2/1967 | Harris | 446/456 |
| 3,400,488 | 9/1968 | Phillpott et al. | 446/456 |
| 3,482,046 | 12/1969 | Hughson et al. | 446/456 |
| 3,596,400 | 8/1971 | Cheng | 446/454 |
| 3,639,755 | 2/1972 | Wrege | 246/187 B |
| 3,705,387 | 12/1972 | Stern et al. | 446/460 |
| 3,722,135 | 3/1973 | Jacobson | 446/454 |
| 3,782,031 | 1/1974 | Byron | 446/292 |
| 3,926,434 | 12/1975 | Cannon, Jr. | 446/455 |
| 4,080,602 | 3/1978 | Hattori et al. | 446/454 |
| 4,087,799 | 5/1978 | Brouwer | 200/61.43 |
| 4,135,181 | 1/1979 | Bogacki et al. | 340/310.01 |
| 4,141,553 | 2/1979 | Beny et al. | 463/63 |
| 4,171,468 | 10/1979 | Reiner | 370/213 |
| 4,197,672 | 4/1980 | Mabuchi et al. | 446/456 |
| 4,213,270 | 7/1980 | Oda | 446/456 |
| 4,226,292 | 10/1980 | Monte et al. | 446/456 |
| 4,247,107 | 1/1981 | Smith, III et al. | 463/62 |
| 4,334,221 | 6/1982 | Rosenhagen et al. | 463/6 |
| 4,406,085 | 9/1983 | Rhodes | 446/456 |
| 4,563,626 | 1/1986 | Ohtake | 446/454 |
| 4,654,659 | 3/1987 | Kubo | 446/454 |
| 4,817,948 | 4/1989 | Simonelli | 463/6 |
| 4,938,483 | 7/1990 | Yavetz | 446/456 |
| 5,073,750 | 12/1991 | Coron | 446/454 |
| 5,098,110 | 3/1992 | Yang | 463/39 |
| 5,135,427 | 8/1992 | Suto et al. | 446/433 |
| 5,148,159 | 9/1992 | Clark et al. | 340/825.22 |
| 5,364,108 | 11/1994 | Esnouf | 273/432 |
| 5,429,543 | 7/1995 | Tilbor et al. | 446/456 |
| 5,435,553 | 7/1995 | Arima et al. | 463/6 |
| 5,435,768 | 7/1995 | Dunleavy | 446/456 |
| 5,452,901 | 9/1995 | Nakada et al. | 446/454 |
| 5,471,668 | 11/1995 | Soenen et al. | 455/352 |
| 5,474,486 | 12/1995 | Chilton et al. | 446/456 |

FOREIGN PATENT DOCUMENTS

| | | |
|---|---|---|
| 3702338 | 9/1987 | Denmark . |
| 2498468 | 7/1982 | France . |

*Primary Examiner*—Jessica J. Harrison
*Assistant Examiner*—James Schaaf
*Attorney, Agent, or Firm*—Ellsworth R. Roston; Fulwider Patton Lee & Utecht, LLP

[57] ABSTRACT

Pads remotely control the operation of vehicles. In each pad, (a) at least a first control provides for the addressing of one of the vehicles, (b) second controls provide for the movement of the addressed vehicle and (c) third controls provide for the operation of members (e.g. pivotable bins) in the selected vehicle. Each pad provides a carrier signal, preferably common with the carrier signals from the other pads. Each pad modulates the carrier signal in accordance with the operation of the pad controls. The first control in each pad provides an address distinctive to the addressed vehicle and modulates the carrier signal in accordance with such address. Each pad sends the modulated carrier signals to the vehicles in a pseudo random pattern, different for each pad, with respect to time. Each vehicle demodulates the carrier signals to recover the address such vehicle. Each vehicle then provides a movement of such vehicle and an operation of the members in such vehicle in accordance with the modulations provided in the carrier signal by the operation of the second and third controls in the pad addressing such vehicle. Each vehicle is controlled by one of the pads for the time period that such pad sends control signals to such vehicle within a particular period of time from the last transmission of such control signals to such vehicle. Thereafter such vehicle can be addressed by such pad or by any other pad.

58 Claims, 3 Drawing Sheets

SYSTEM FOR, AND METHOD OF, CONTROLLING THE OPERATION OF TOYS

This invention relates to a system for and method of, operating remotely controlled vehicles simultaneously in a somewhat confined area to provide pleasurable use by people of all ages with youthful minds. In the system and method of this invention, the vehicles can be remotely controlled to perform competitive or cooperative tasks. The system of this invention includes pads for operation by the users and vehicles remotely controlled by the pads in accordance with the operation of the pads. In addition to the inventive aspects of the system and the method disclosed above, each of the pads and the vehicles includes features of an inventive nature. The system and method of this invention may also include stationary plants (e.g. power plants and elevators) which are controlled by the operation of the pads. The invention additionally relates to methods for controlling the operation of the vehicles on a remotely controlled basis by the operation of the pads.

BACKGROUND OF THE INVENTION

Various types of play systems exist, and have existed for some time, in which vehicles are moved on a remotely controlled basis. However, such systems generally provide one hand-held unit and one remotely controlled vehicle for operation by the hand-held unit. Examples of a vehicle in such a system are an automobile or an airplane. Furthermore, the functions of the remotely controlled unit, other than movement along a floor or along the ground or in the air, are quite limited.

Other types of play systems involve the use of blocks for building structures. These blocks often include components in the blocks for providing an interlocking relationship between abutting blocks. In this way, elaborate structures can be created by users with creative minds. However, such structures are generally built by hand.

Tests have indicated that there is a desirability, and even a need, for play systems in which vehicles are remotely operated to perform functions other than to move aimlessly along a floor or along the ground. For example, tests have indicated that there is a desirability, and even a need, for a play system in which the remotely controlled vehicles can transport and manipulate elements such as blocks to construct creative structures. There is also a desirability, and even a need, for play systems in which a plurality of vehicles can be remotely controlled by elements such as switches in hand-held pads to compete against one another in performing a first task or to cooperate in performing a second task such as building a miniature community through the transport and manipulation of miniature blocks. Such a desirability, or even a need, has existed for a long period of time, probably decades, without a satisfactory resolution.

Application Ser. No. 08/580,753 filed by John Crane on Dec. 29, 1995, for a REMOTE CONTROL SYSTEM FOR OPERATING TOYS and assigned of record to the assignee of record of this application provides a play system for use by people of all ages with youthful minds. It provides for a simultaneous control by each player of an individual one of a plurality of remotely controlled vehicles. This control is provided by the operation by each such player of switches in a hand-held unit or pad to control the movement of an individual one of a plurality of remotely controlled vehicles and the performance of different functions (e.g. the movement of blocks or marbles) by such remotely controlled vehicle. Each of the remotely controlled vehicles in the system disclosed and claimed in application Ser. No. 08/580,753 can be operated in a competitive relationship or a cooperative relationship with others of the remotely controlled vehicles. The vehicles can be constructed to grasp, lift and transport elements such as blocks or marbles and to deposit such elements at selectively displaced positions.

In one embodiment of the system disclosed and claimed in application Ser. No. 08/580,753, switches in pads control, when manually closed, the selection of toy vehicles and the operation of motors for moving the vehicles forwardly, rearwardly, to the left and to the right and moving upwardly and downwardly (and rightwardly and leftwardly) a receptacle for holding transportable elements (e.g. marbles or blocks).

When sequentially and cyclically interrogated by a central station, each pad in the system disclosed and claimed in application Ser. No. 08/580,753 sends through wires to the central station signals indicating the switch closures in such pad. Such central station produces first binary signals addressing the vehicle selected by such pad and second binary signals identifying the motor control operations in such vehicle. Thereafter the switches identifying in such pad the motor control operations in such selected vehicle can be closed without closing the switches identifying such vehicle.

The first and second signals for each vehicle in the system disclosed and claimed in application Ser. No. 08/580,753 are transmitted by wireless by the central station to all of the vehicles at a common carrier frequency modulated by the first and second binary signals. The vehicle identified by the transmitted address demodulates the modulating signals and operates its motors to move the vehicle in accordance with such demodulation. When a vehicle fails to receive signals through the central station from a pad for a particular period of time, the vehicle selected by such pad becomes available for selection thereafter by such pad or by another pad. Furthermore, such pad can thereafter select that vehicle or another vehicle.

A cable in the system disclosed and claimed in application Ser. No. 08/580,753 may couple two (2) central stations (one as a master and the other as a slave) to increase the number of pads controlling the vehicles. Stationary accessories (e.g. an elevator) connected by wires to the central station become operative when selected by the pads. The wires carry power to the central station in the system disclosed and claimed in application Ser. No. 08/580,753.

BRIEF DESCRIPTION OF THE INVENTION

In one embodiment of the invention, individual ones of pads remotely control the operation of selective ones of vehicles. In each pad, (a) at least a first control provides for the selection of one of the vehicles, (b) second controls provide for the movement of the selected vehicle and (c) third controls provide for the operation of working members (e.g. pivotable bins) in the selected vehicle.

Each pad provides a carrier signal, preferably common with the carrier signals from the other pads. Each pad modulates the carrier signal in accordance with the operation of the pad controls. The first control in each pad provides an address distinctive to the selected one of the vehicles and modulates the carrier signal in accordance with such address. Each pad sends the modulated carrier signals to the vehicles in a pseudo random pattern, different for each pad, with respect to time.

Each vehicle demodulates the carrier signals to recover the address distinctive to such vehicle. Each vehicle then provides a movement of such vehicle and an operation of the working members in such vehicle in accordance with the modulations provided in the carrier signal by the operation of the second and third controls in the pads selecting such vehicle.

Each vehicle is controlled by an individual one of the pads for the time period that such pad sends control signals to such vehicle within a particular period of time from the last transmission of such control signals to such vehicle. Thereafter such vehicle can be selected by such pad or by another pad.

DETAILED DESCRIPTION OF THE INVENTION

Figure 1:
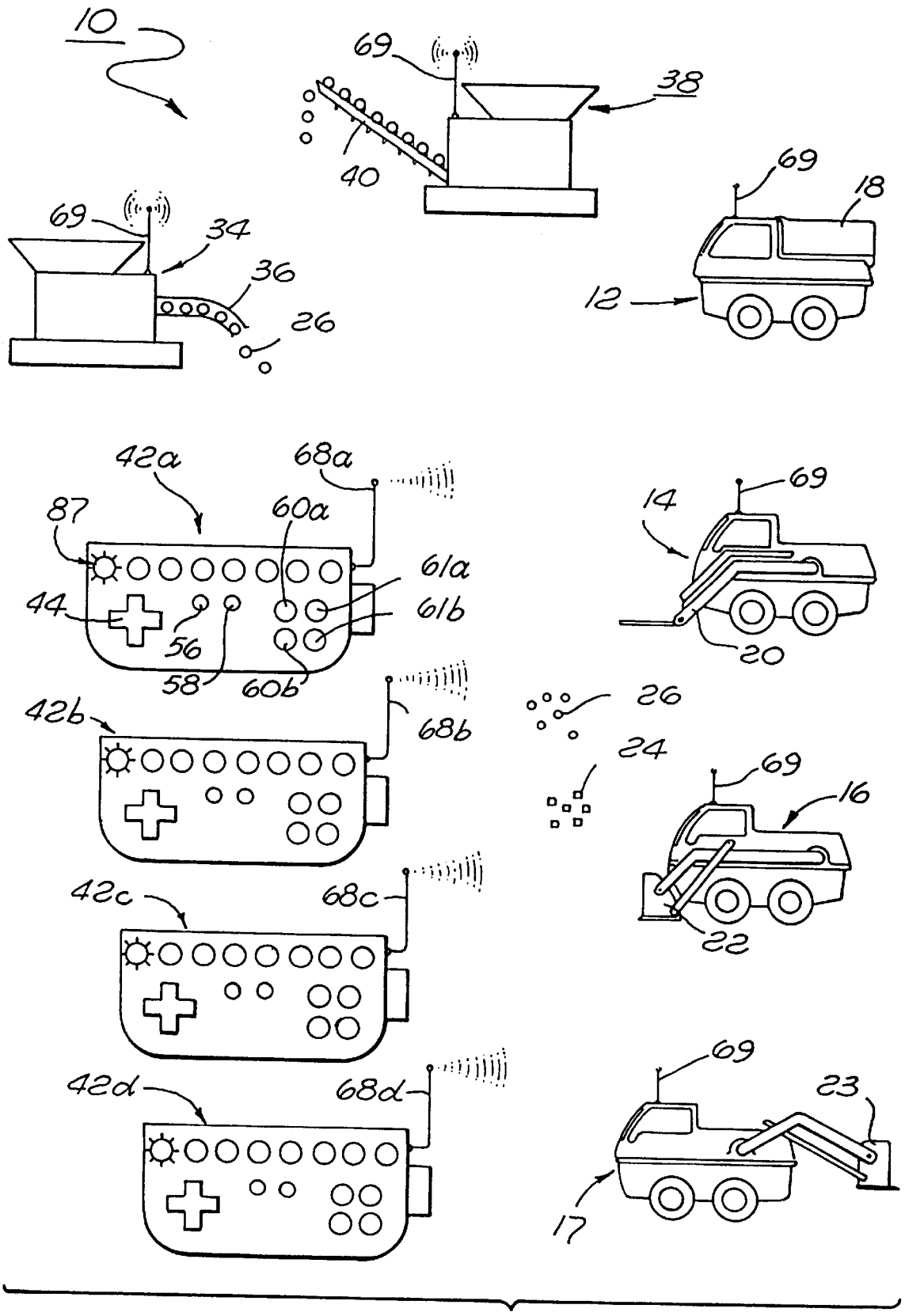
FIG. 1 is a schematic diagram, primarily in block form, of a system constituting one embodiment of the invention.

In one embodiment of the invention, a system generally indicated at 10 in FIG. 1 is provided for controlling the selection and operation of a plurality of toy vehicles. Illustrative examples of toy vehicles constitute a dump truck generally indicated at 12, a fork lift generally indicated at 14, a skip loader generally indicated at 16 and another form of skip loader generally indicated at 17. The toy vehicles such as the dump truck 12, the fork lift 14 and the skip loaders 16 and 17 are simplified versions of commercial units performing functions similar to those performed by the toy vehicles 12, 14, 16 and 17.

For example, the dump truck 12 may include a working or transport member such as a pivotable bin or container 18; the fork lift 14 may include a working or transport member such as a pivotable platform 20; the skip loader 16 may include a working or transport member such as a pivotable bin or container 22 disposed at the front end of the skip loader; and the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1.

Each of the dump truck 12, the fork lift 14 and the skip loaders 16 and 17 may include a plurality of motors. For example, the dump truck 12 may include a pair of reversible motors 28 and 30 (FIG. 3) operable to move the dump truck forwardly, rearwardly, to the right and to the left. The motor 28 controls the movement of the front and rear left wheels and the motor 30 controls the movement of the front and rear right wheels. Similar motors may be provided for each of the fork lift 14 and the skip loaders 16 and 17.

When the motors 28 and 30 are simultaneously operated in one direction, the dump truck 12 moves forwardly. The vehicle 12 moves rearwardly when the motors 28 and 30 are in the opposite direction. The vehicle 12 turns toward the left when the motor 30 is operated without a simultaneous operation of the motor 28. The vehicle 12 turns toward the right when the motor 28 is operated without a simultaneous operation of the motor 30.

The vehicle 12 spins to the left when the motor 30 operates to move the vehicle forwardly at the same time that the motor 28 operates to move the vehicle rearwardly. The vehicle 12 spins to the right when the motors 28 and 30 are operated in directions opposite to the operations of the motors in spinning the vehicle to the left.

Another reversible motor 32 in the dump truck 12 operates in one direction to pivot the bin 18 upwardly and in the other direction to pivot the bin downwardly. An additional motor 33 may operate in one direction to turn the bin 18 to the left and in the other direction to turn the bin to the right.

The construction of the motors 28, 30, 32 and 33 and the disposition of the motors in the dump truck 12 to operate the dump truck are considered to be well known in the art. The fork lift 14 and the skip loaders 16 and 17 may include motors corresponding to those described above for the dump truck 12.

The system 10 may also include stationary plants or accessories. For example, the system 10 may include a pumping station generally indicated at 34 (FIG. 1) for pumping elements such as the marbles 26 through a conduit 36. The system may also include a conveyor generally indicated at 38 for moving the elements such as the marbles 26 upwardly on a ramp 40. When the marbles 26 reach the top of the ramp 40, the marbles may fall into the bin 18 in the dump truck 12 or into the bin 22 in the skip loader 16. For the purposes of this application, the construction of the pumping station 34 or the conveyor 38 may be considered to be within the purview of a person of ordinary skill in the art.

The system 10 may also include a plurality of hand-held pads generally indicated at 42*a*, 42*b*, 42*c* and 42*d* (FIG. 1). Each of the pads 42*a*, 42*b*, 42*c* and 42*d* may have a substantially identical construction. Each of the pads 42*a*, 42*b*, 42*c* and 42*d* may include a plurality of actuatable buttons. For example, each of the pads may include a 4-way button 44 in the shape of a cross. Each of the different segments in the button 44 is connected to an individual one of a plurality of switches 46, 48, 50 and 52 in FIG. 2.

When the button 44 is depressed at the segment at the top of the button, the switch 46 is closed to obtain the operation of the motors 28 and 30 (FIG. 3) in moving the vehicle 12 forwardly. Similarly, when the segment at the bottom of the button 44 is depressed, the switch 48 is closed to obtain the operation of the motors 28 and 30 (FIG. 3) in moving the vehicle 12 rearwardly. The operation of the right and left segments of the button 44 cause the motors 28 and 30 to operate spinning the vehicle in individual ones of the two (2) opposite directions.

It will be appreciated that pairs of segments of the button 44 may be simultaneously depressed. For example, the top and left portions of the button 44 may be simultaneously depressed to obtain a simultaneous movement of the vehicle 12 forwardly and to the left. This is in accordance with the operation of a microcontroller which will be described in detail subsequently. However, a simultaneous actuation of the top and bottom segments of the button 44 will not have any effect since they represent contradictory commands. This is also true of a simultaneous depression of the left and right segments of the button 44.

Figure 2:
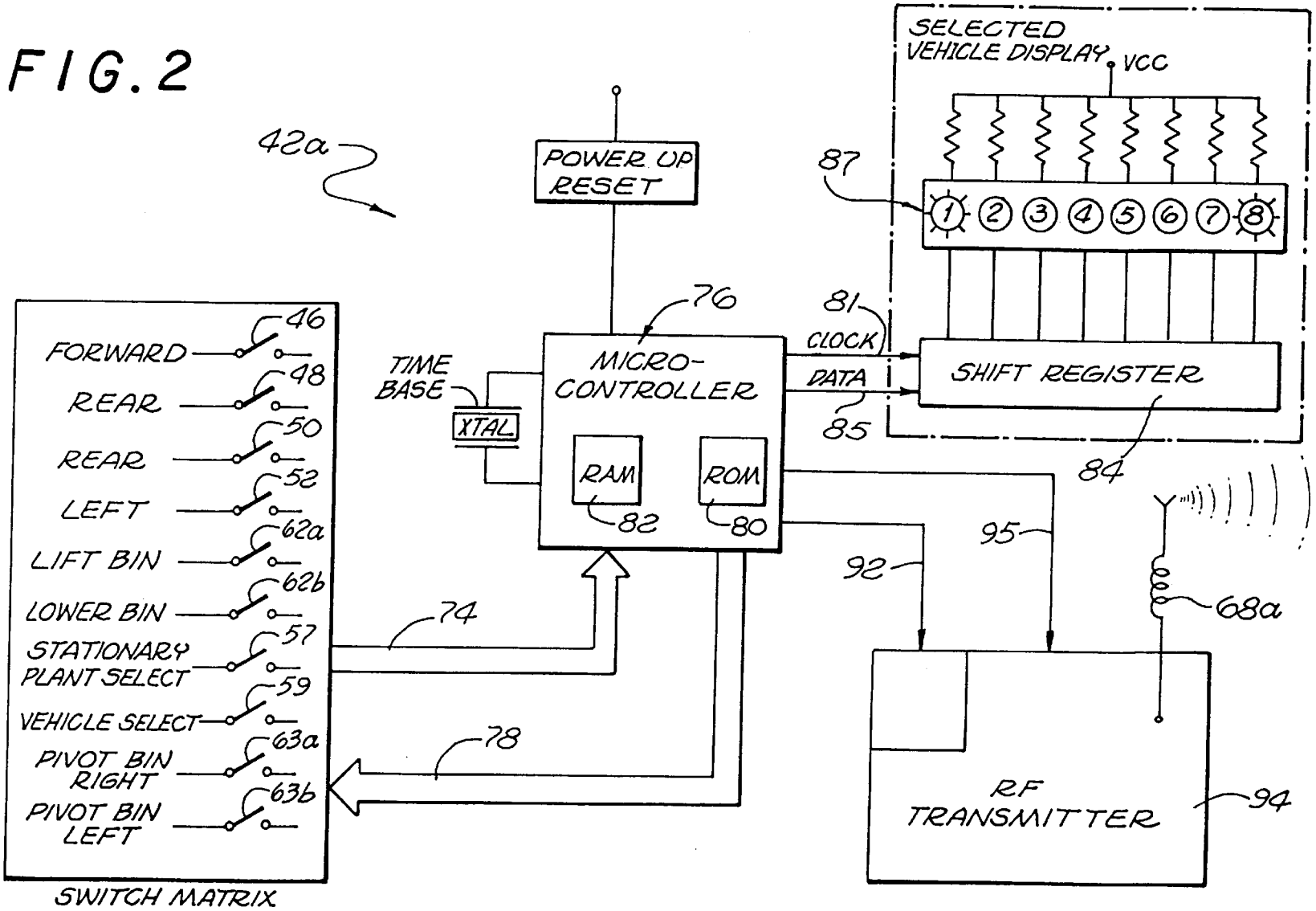
FIG. 2 is a schematic diagram, primarily in block form, of the different features in a pad included in the system shown in FIG. 1.

Each of the pads 42*a*, 42*b*, 42*c* and 42*d* may include a button 56 (FIG. 1) which is connected to a switch 57 (FIG. 2). Successive depressions of the button 56 on one of the pads within a particular period of time cause different ones of the stationary accessories or plants such as the pumping station 34 and the conveyor 38 to be energized. For example, a first depression of the button 56 in one of the pads 42*a*, 42*b*, 42*c* and 42*d* may cause the pumping station 34 to be energized and a second depression of the button 56 in such pad within the particular period of time may cause the conveyor 38 to be energized instead of the pumping station. When other stationary accessories are included in the system 10, each may be individually energized by depressing the button 56 a selective number of times within the particular period of time. This energizing of a selective one of the stationary accessories occurs at the end of the particular period of time.

A button 58 is provided in each of the pads 42*a*, 42*b*, 42*c* and 42*d* to select one of the vehicles 12, 14, 16 and 17. The individual one of the vehicles 12, 14, 16 and 17 selected at any instant by each of the pads 42*a*, 42*b*, 42*c* and 42*d* is dependent upon the number of times that the button is depressed in that pad within a particular period of time. For example, one (1) depression of the button 58 may cause the dump truck 12 to be selected and two (2) sequential selections of the button 58 within the particular period of time may cause the fork lift 14 to be selected. An adder is included in the pad 12 to count the number of depressions of the button 56 within the particular period of time.

Every time that the button 58 is actuated or depressed within the particular period of time, a switch 59 in FIG. 2 is closed. The particular period of time for depressing the button 58 may be the same as, or different from, the particular period of time for depressing the button 56. An adder is included in the pad 12 to count the number of depressions of the button 58 within the particular period of time. This count is converted into a plurality of binary signals indicating the count. The count is provided at the end of the particular period of time.

Buttons 60*a* and 60*b* are also included on each of the pads 42*a*, 42*b*, 42*c* and 42*d*. When depressed, the buttons 60*a* and 60*b* respectively close switches 62*a* and 62*b* in FIG. 2. The closure of the switch 62*a* is instrumental in producing an operation of the motor 32 in a direction to lift the bin 18 in the dump truck 12 when the dump truck has been selected by the proper number of depressions of the button 58. In like manner, when the dump truck 12 has been selected by the proper number of depressions of the switch 58, the closure of the switch 62*b* causes the bin 18 in the dump truck 12 to move downwardly as a result of the operation of the motor 32 in the reverse direction.

It will be appreciated that other controls may be included in each of the pads 42*a*, 42*b*, 42*c* and 42*d*. For example, buttons 61*a* and 61*b* may be included in each of the pads 42*a*, 42*b*, 42*c* and 42*d* to pivot the bin 18 to the right or left when the vehicle 12 has been selected. Such movements facilitate the ability of the bin 18 to scoop elements such as the blocks 24 and the marbles 26 upwardly from the floor or ground or from any other position and to subsequently deposit such elements on the floor or ground or any other position.

Switches 63*a* and 63*b* (FIG. 2) are respectively provided in the pad 42*a* in association with the buttons 61*a* and 61*b* and are closed by the respective actuation of the buttons 61*a* and 61*b* to move the bin or the platform in the vehicle 12 to the left or right when the vehicle has been selected. It will be appreciated that different combinations of buttons may be actuated simultaneously to produce different combinations of motions. For example, a bin in a selected one of the vehicles may be moved at the same time that the selected one of the vehicles is moved.

Each of the pads 42*a*, 42*b*, 42*c* and 42*d* processes the signals produced in such pad as a result of the closure of the switches in such pad and sends the processed signals to the vehicles 12, 14, 16 and 17 when the button 58 on an individual one of the pads has been depressed to indicate that the information from such pad is to be sent to the vehicles. The transmission may be on a wireless basis from antennas 68*a*, 68*b*, 68*c* and 68*d* (FIG. 1) in the respective ones of the pads 42*a*, 42*b*, 42*c* and 42*d* to antennas 69 on the vehicles.

The transmission may be in packets of signals. This transmission causes the selected ones of the vehicles 12, 14, 16 and 17 to perform individual ones of the functions directed by the depression of the different buttons on the individual ones of the pads. When the commands from the individual ones of the pads 42*a*, 42*b*, 42*c* and 42*d* are to pass to the stationary accessories 34 and 38 as a result of the depression of the buttons 56 on the individual ones of the pads, the pads process the commands and send signals to the selected ones of the stationary accessories. These signals may pass to the selected ones of the stationary accessories or on a remote wireless basis as to antennas 71.

FIG. 2 shows the construction of the pad 42*a* in additional detail. It will be appreciated that each of the pads 42*b*, 42*c* and 42*d* may be constructed in a substantially identical manner to that shown in FIG. 2. As shown in FIG. 2, the pad 42*a* includes the switches 46, 48, 50 and 52 and the switches 57, 59, 62*a*, 62*b*, 63*a* and 63*b*. Buses 74 are shown as directing indications from the switches 46, 48, 50, 52, 57, 59, 62*a*, 62*b*, 63*a* and 63*b* to a microcontroller included in the pad 42*a* and generally indicated at 76 in FIG. 2. Buses 78 are shown for directing signals from the microcontroller 76 to the switches in the pad 42*a*.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the pad 42*a* provide indications of whether or not they have been closed. The random access memory 82 may receive this sequence from the read only memory 80 and may store indications of whether or not the switches in the particular sequence have been closed for each individual one of the pads 42*a*, 42*b*, 42*c* and 42*d*. This sequence of switch openings and closings is then used to modulate the carrier signals transmitted on a wireless basis from the pad 42*a*.

As previously indicated, the pad 42*a* selects one of the vehicles 12, 14, 16 and 17 in accordance with the number of closings of the switch 59 within a particular period of time. As the user of the pad 42*a* provides successive actuations or depressions of the button 58, signals are introduced to a shift register 84 through a line 85 to indicate which one of the vehicles 12, 14, 16 and 17 would be selected if there were no further depressions of the button. Each of the depressions of the button 58 causes the indication to be shifted to the right in the shift register 84. Such an indication is provided on an individual one of a plurality of light emitting diodes (LED) generally indicated at 87. The shifting of the indication in the shift register 84 may be synchronized with a clock signal on a line 81. Thus, the illuminated one of the light emitting diodes 87 at each instant indicates at that instant the individual one of the vehicles 12, 14, 16 and 17 that the pad 42*a* has selected at such instant.

Each of the pads 42*a,* 42*b,* 42*c* and 42*d* formulates in binary form a composite address identifying such pad and the selected one of the vehicles 12, 14, 16 and 17 and stores this composite address in the random access memory 82. For example, the pad 42*a* may form a composite address identifying itself and also identifying the vehicle 12 when the pad 42*a* has selected the vehicle 12. The pad 42*a* then provides a packet or sequence of signals in binary form including the composite address and including the status of the opening and closing of each of the switches in the pad 42*a.* This packet or sequence indicates in binary form the status of the closure each of the switches 46, 48 50 and 52 and the switches 57, 59, 62*a,* 62*b,* 63*a* and 63*b* in the pad.

Each packet of information including the composite address and the switch closure information for the pad 42*a* is introduced through a line 92 in FIG. 2 to a radio frequency transmitter 94 in the pad. The radio frequency transmitter 94 is enabled by a signal through a line 95 from the microcontroller 76. This enabling signal is produced by the microcontroller 76 when the microcontroller confirms that it has received signals from the different switches in the pad 42*a.* Radio frequency transmitters are provided in each of the pads 42*b,* 42*c* and 42*d* corresponding to the radio frequency transmitter 94 in the pad 42*a.*

When the radio frequency transmitter 94 receives the enabling signal and the address and data signals from the pad 42*a,* the antenna 68*a* (also shown in FIG. 1) transmits signals to all of the vehicles 12, 14, 16 and 17. However, only the individual one of the vehicles 12, 14, 16 and 17 with the address indicated in the packet of signals from the pad 42*a* will respond to such packet of signals. In the example discussed above, only the vehicle 12 will respond to the signals from the pad 42*a* because only the vehicle 12 is addressed by the pad 42*a.*

Furthermore, in the example above where the pad 42*a* has previously selected the vehicle 12, the microcontroller 76 in the pad 42*a* will cause the vehicle 12 to be released when the pad 42*a* thereafter selects any of the vehicles 14, 16 and 17. When the vehicle 12 becomes released, it becomes available immediately thereafter to be selected by any one of the pads 42*a,* 42*b,* 42*c* and 42*d.* The release of the vehicle 12 by the pad 42*a* and the coupling between the pad 42*a* and a selected one of the vehicles 12, 14, 16 and 17 are recorded in the random access memory 82 in the microcontroller 76.

The vehicles 12, 14, 16 and 17 are battery powered. As a result, the energy in the batteries in the vehicles 12, 14, 16 and 17 tends to become depleted as the batteries provide the energy for operating the vehicles. The battery in the vehicle 12 is indicated at 92 in FIG. 3. The battery 92 is chargeable because the vehicle is constructed to receive AC power from a wall socket. The battery 92 is charged only for a particular period of time. This particular period of time is preset in the read only memory 104 in each of the vehicles. When each battery is being charged for the particular period of time, a light 93 in a circuit with the battery becomes illuminated. The charging current to the battery 92 may be limited by a resistor 96. The light 93 becomes extinguished when the battery 92 has been charged.

Figure 3:
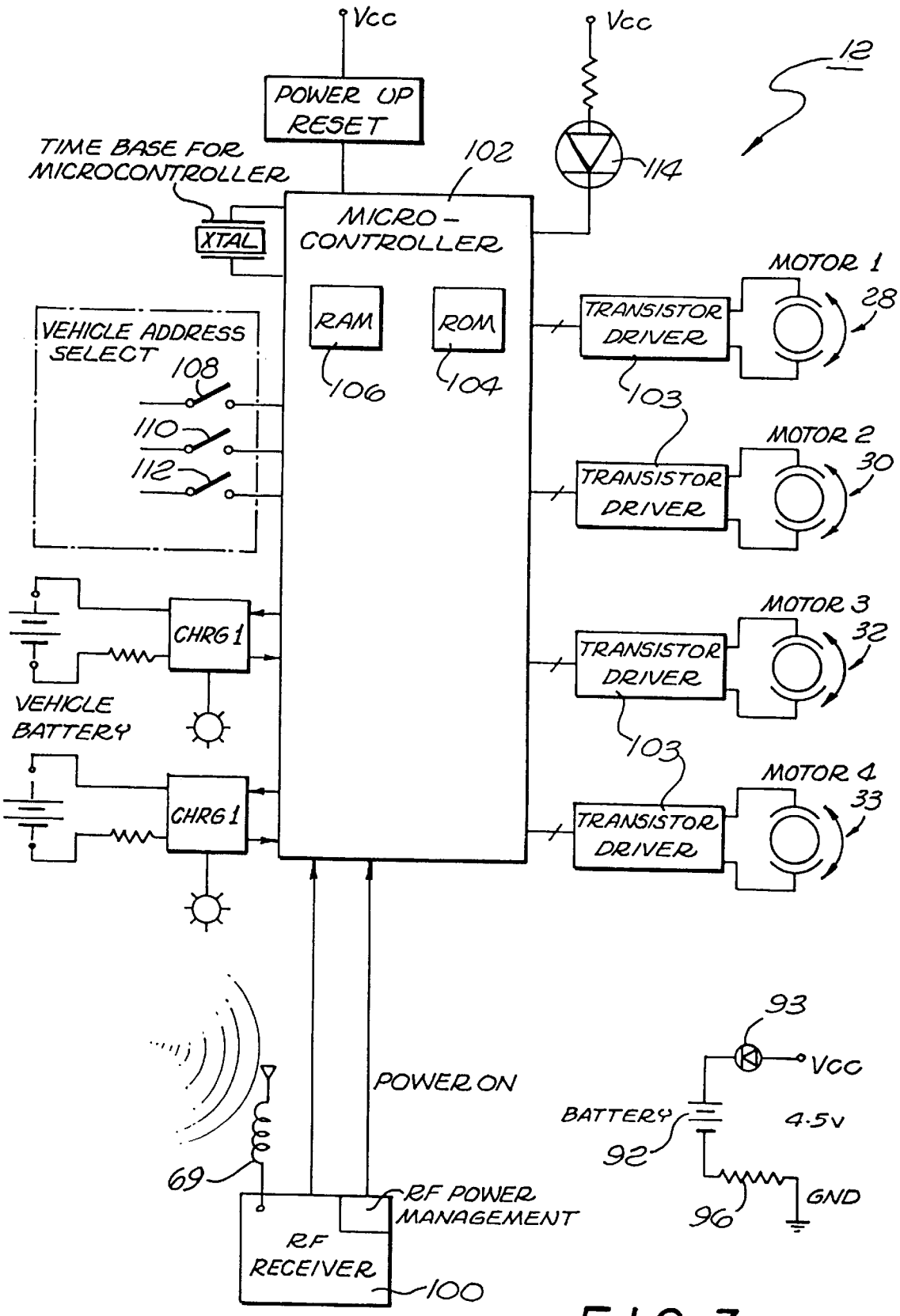
FIG. 3 is a schematic diagram, primarily in block form, of the different features in a vehicle included in the system shown in FIG. 1.

The vehicle 12 is shown in additional detail in FIG. 3. Substantially identical arrangements may be provided for the vehicles 14, 16 and 17. The vehicle 12 includes the antenna 69 for receiving from one of the pads such as the pad 42*a* signals with the address of the vehicle and also includes a receiver 100 for processing the received signals. The vehicle 12 also includes the motors 28, 30, 32 and 33. Each of the motors 28, 30, 32 and 33 receives signals from an individual one of transistor drivers 103 connected to a microcontroller generally indicated at 102.

The microcontroller 102 includes a read only memory (ROM) 104 and a random access memory (RAM) 106. As with the memories in the pad 42*a,* the read only memory 104 may store permanent information and the random access memory 106 may store volatile (or impermanent) information. For example, the read only memory 104 may store information indicating the sequence of the successive bits of information in each packet for controlling the operation of the motors 28, 30, 32 and 33 in the vehicle 12. The random access memory 106 may store information indicating whether there is a binary 1 or a binary 0 at each successive bit in the packet.

The vehicle 12 includes a plurality of switches 108, 110 and 112. These switches are generally pre-set at the factory to indicate a particular Arabian number such as the number "5". However, the number can be modified by the user to indicate a different number. The number can be modified by the user by changing the pattern of closure of the switches 108, 110 and 112. The pattern of closure of the switches 108, 110 and 112 controls the selection of the vehicle such as the vehicle 12. For example, the pattern of closure of the switches 108, 110 and 112 can be changed when another user brings to a first user's system, from such other user's system, another vehicle identified by the number "5" and the first user's system already includes a vehicle identified by the numeral "5".

The vehicle 12 also includes a light such as a light emitting diode 114. This diode is illuminated when the vehicle 12 is selected by one of the pads 42*a,* 42*b,* 42*c* and 42*d.* In this way, the other users can see that the vehicle 12 has been selected by one of the pads 42*a,* 42*b,* 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has selected. It will also be appreciated that each of the vehicles 14, 16 and 17 includes a light such as a light emitting diode corresponding to the light emitting diode 114 in the vehicle 12.

As previously indicated, the user of one of the pads such as the pad 42*a* selects the vehicle 12 by successively depressing the button 58 a particular number of times within a particular time period. This causes the pad 42*a* to produce an address identifying the vehicle 12. When this occurs, the vehicle 12 stores information in its random access memory 106 that the pad 42*a* has selected such vehicle. Because of this, the user of the pad 42*a* does not thereafter have to depress the button 58 during the time that the pad 42*a* is directing commands to the vehicle 12. This simplifies the operation of the pad 42*a* to control the operation of the vehicle 12. As long as the buttons on the pad 42*a* are thereafter depressed within a particular period of time to command the vehicle 12 to perform individual functions, the microcontroller 102 in the vehicle 12 will direct the vehicle to respond to commands from the pad 42*a.* The vehicle 12 can respond to the commands because the pad 42*a* sends its address even though it may not send the address of the vehicle 12.

The read only memory 104 in the microcontroller 102 at the vehicle 12 stores information indicating a particular period of time in which the vehicle 12 has to be addressed by the pad 42*a* in order for the selective coupling between the pad and the vehicle to be maintained. The random access memory 106 in the microcontroller 102 at the vehicle 12 stores the period of time from the last time that the pad 42*a* has issued a command to the vehicle 12. When the period of time in the random access memory 106 equals the period of time in the read only memory 104, the vehicle 12 will no longer respond to commands from the pad 42*a* unless the user of the pad 42*a* again depresses the button 58 the correct number of times within the particular period of time to select the vehicle 12. When the vehicle 12 no longer responds to commands from the pad 42*a,* it is free to be selected by any of the pads 42*a,* 42*b,* 42*c* and 42*d.*

As previously indicated, the button 58 in the pad 42*a* does not have to be actuated or depressed to issue the command after the pad 42*a* has initially issued the command by the appropriate number of depressions of the button. When the period of time stored in the random access memory 106 of the microcontroller 102 in the vehicle 12 equals the period of time in the read only memory 104, the microcontroller 102 issues a command to extinguish the light emitting diode 114. This indicates to the different users of the system, including the user previously controlling the operation of the vehicle 12, that the vehicle is available to be selected by one of the users including the user previously directing the operation of the vehicle.

It will be appreciated that the microcontroller 76 in the pad 42*a* may also determine the period of time that the pad 42 has failed to issue a command to the vehicle 12. When this period of time exceeds a period of time stored in the read only memory 80, the microcontroller 76 may issue a command that the pad 42*a* no longer has control over the operation of the vehicle 12. Such an operation of the microcontroller 76 may be in addition to, or instead of, the command issued by the microcontroller 102 in the vehicle 12 as discussed in the previous paragraph.

When one of the vehicles such as the vehicle 12 is being moved in the forward direction, the random access memory 106 records the period of time during which such forward movement of the vehicle 12 is continuously occurring. This period of time is continuously compared in the microcontroller 102 with a fixed period of time recorded in the read only memory 104. When the period of time recorded in the random access memory 106 becomes equal to the fixed period of time recorded in the read only memory 104, the microcontroller 102 provides a signal for increasing the speed of the movement of the vehicle 12 in the forward direction. Similar arrangements are provided for each of the vehicles 14, 16 and 17. This increased speed may illustratively be twice that of the original speed.

Since more than one of the pads 42*a,* 42*b,* 42*c* and 42*d* may be sending signals at approximately the same time or within a limited period such as approximately 0.25 milliseconds, confusion may exist at the vehicles 12, 14, 16 and 17. This is particularly true when the pads send signals to the vehicles at a common carrier frequency. For example, the vehicle 12 may be confused because it is simultaneously receiving signals from the pads 42*a* and 42*b* and cannot separate the signals received from the pad 42*a* from the signals received from the pad 42*b*. This may be resolved by having each of the pads 42*a,* 42*b,* 42*c* and 42*d* send a sequence of signal packets every time that such pad is operated by the user.

The signals in each packet in the sequence may be modulated with the same information as the signals in the other packets in the sequence. The sequence of the signal packets may occur over a period of time significantly less than one (1) second. For example, each sequence may occur in a period of approximately two hundred milliseconds (200 msec.). This sequence tends to limit the possibility that there may be a conflict at one of the vehicles 12, 14, 16 and 17 because more than one of the pads 42*a,* 42*b,* 42*c* and 42*d* may be transmitting signals to the vehicles at the same time.

The possibility of a conflict in the reception at the vehicles 12, 14, 16 and 17 of signals from more than one of the pads 42*a,* 42*b,* 42*c* and 42*d* becomes even more significantly reduced by making the successive packets of the signals in the sequence from each of the pads 42*a,* 42*b,* 42*c* and 42*d* pseudo random with respect to time. This possibility becomes substantially eliminated by making the pseudo random sequence of the signal packets with respect to time from each of the pads 42*a,* 42*b,* 42*c* and 42*d* different from the pseudo random sequence with respect to time from the other pads.

It will be appreciated that the possibility of collisions between the reception by the vehicle 12 of signals simultaneously from more than one of the pads is minimized from the outset by limiting the transmissions of signals from the pads only when the controls in the pads are operated. Each of the pads is generally operated only to change the movement of the vehicle selected by such pad or to change the operation of the driving members in such pad. At times, however, each of the pads may be operated to maintain a previous course of action in the vehicle selected by such pad when the time is expiring for such pad to maintain control over the operation of such selected vehicle unless such pad sends additional control signals to such vehicle. The discussion in this paragraph applies with equal effect to each of the vehicles 14, 16 and 17.

The system and method described above have certain important advantages. They provide for the operation of a plurality of vehicles by a plurality of users, either on a competitive or a co-operative basis. Furthermore, the vehicles can be operated on a flexible basis in that a vehicle can be initially selected for operation by one user and can then be selected for operation by another user after the one user has failed to operate the vehicle for a particular period of time. The vehicles being operated at each instant are also visible by the illumination of the lights 114 on the vehicle. The apparatus and method of this invention are also advantageous in that the vehicles are operated on a wireless basis without any physical or cable connection between the vehicles such as the vehicles 12, 14, 16 and 17 and the pads such as the pads 42*a,* 42*b,* 42*c* and 42*d* selecting the vehicles.

Furthermore, the pads such as the pads 42*a,* 42*b,* 42*c* and 42*d* are able to communicate with the vehicles in the plurality through a single carrier frequency. The system and method of this invention are also advantageous in that the vehicles can selectively perform a number of different functions including movements forwardly and rearwardly and to the left and the right and including movements of a container or bin or platform on the vehicle upwardly and downwardly or to the left or the right. Different movements can also be provided simultaneously on a coordinated basis. All of these movements for each vehicle are provided by the operation of controls on the individual one of the pads selecting the vehicle.

The system and method of this invention are also advantageous in the provision of the pads and the provision of the button and switches in the pads. As will be appreciated, the pads are able to select vehicles and/or stationary accessories through the operation of a minimal number of buttons and to provide for the operation of a considerable number of different function in the vehicles with a minimal number of buttons. The pads are able to communicate the selection of vehicles on a remote and wireless basis to the vehicles.

After selecting a vehicle, each pad does not thereafter have to indicate the identity of the vehicle as long as the pad operates the vehicle on a remote and wireless basis within a particular period of time from the last operation of the vehicle by the pad. Under such circumstances, it is sufficient for the pad to identify its own address to the selected vehicle within the particular period of time in order to continue to operate the selected vehicle.

The system and method of this invention also provide other advantages. Each pad communicates with its selected vehicle only when the user of the pad wishes to maintain the operation of the selected vehicle by communicating this to the vehicle through another command or only when the user of the pad wishes to change the movement of the selected vehicle or the operation of the working member in the vehicle. Furthermore, each pad communicates its commands to its selected vehicle in a sequence of packets where the packets in each sequence have a pseudo random pattern with respect to time, this pattern being different for each vehicle than the pseudo random pattern with respect to time for the other vehicles. In this way, each vehicle can detect and process signals from the pad controlling the operation of such vehicle even when another pad is sending signals to its selected vehicle at approximately the same time.

Although this invention has been disclosed and illustrated with reference to particular embodiments, the principles involved are susceptible for use in numerous other embodiments which will be apparent to persons of ordinary skill in the art. The invention is, therefore, to be limited only as indicated by the scope of the appended claims.

I claim:

1. In combination, a plurality of vehicles each having first controls to provide a movement of the vehicle in different directions in accordance with the operation of the first controls and each having a member operable to perform functions independent of the movement of the vehicle and each having second controls to obtain the performance of the functions by the operable member, a plurality of pads each having a plurality of switches controlling the addressing of any one of the vehicles and controlling the operation of the operative member in the addressed vehicle, each of the pads including first means responsive to the operations of the switches in the pad for providing signals for addressing the vehicle and for providing for movements of the vehicle and for the operation of the operable member in the, and each of the pads providing a wireless transmission of the signals from the pad to the vehicles, each of the vehicles being responsive to the signals addressing the vehicle for providing for the operation of the first and second controls in the vehicle in accordance with the signals transmitted to the vehicle from the pad addressing the vehicle, and means in each of the vehicles for making the vehicle available for addressing by any one of the pads when the vehicle fails to receive signals within a particular period of time from the pad previously addressing the vehicle.

2. In a combination as recited in claim 1, second means responsive in each of the pads to the operation of the switches in the pad for transmitting signals indicating the operation of the switches, and third means included in each of the vehicles for receiving the signals transmitted by the pad to obtain an operation of the first and second controls in the vehicle in accordance with the signals addressed to the vehicle by the pad.

3. In a combination as recited in claim 2, fourth means responsive to the signals from the second means for each of the pads to produce signals at a carrier frequency and to modulate the signals in accordance with the operation of the switches in the pad, the carrier frequency being common to the carrier frequency of the signals from the fourth means in the other ones of the pads, and fifth means disposed at each of the vehicles for demodulating the signals addressed at the carrier frequency to the vehicle to energize the vehicle and to produce the movements of the vehicle and the operation of the operable member in the vehicle.

4. In a combination as set forth in claim 2, the second means in each the pads being operative to transmit the signals in a time pattern different from the time pattern of the signals from the other lads.

5. In combination, a plurality of vehicles each movable forwardly and rearwardly and each turnable in first and second opposite directions and each having a member operable independently of the movement of the vehicle, each of the vehicles having drive members providing for the movement of the vehicle forwardly and rearwardly and turnable in the opposite directions, a plurality of pads each constructed to address any one of the vehicles and each having a plurality of controls individually operable to address one of the vehicles and to indicate to the addressed vehicle the drive members to be actuated in the addressed vehicle and the type of actuation to be provided to the drive members in the addressed vehicle, and first means in each of the pads for sending on a wireless basis signals addressing one of the vehicles and providing for the operation of the drive members and the operable members in the vehicle in accordance with the operation of the controls in the pad to provide controlled movements of the addressed vehicle forwardly and rearwardly and controlled turnable movements of the addressed vehicle in the first and second opposite directions and controlled operations of the operable member, the first means in each of the pads providing address signals with characteristics individual to the addressed vehicle to obtain an operation only of the vehicle addressed by the pad, and second means in each of the pads for providing for the wireless transmission of the signals by the pad to the vehicles in a pseudo random pattern with respect to time, the pseudo random pattern of the signals from each of the pads being different from the pseudo random pattern of the signals from the other pads.

6. In a combination as set forth in claim 5, the first means in each of the pads including means for providing a carrier signal having a common carrier frequency for all of the vehicles and for modulating the common carrier signal with signals addressing one of the vehicles and for identifying the the drive members to be operated in the addressed vehicle and the operations to be performed by the drive members in the addressed vehicle.

7. In a combination as set forth in claim 6, each of the addressed vehicles including means for receiving the carrier signal from the the pad addressing the vehicle and for demodulating the carrier signal and for operating the drive members in the addressed vehicle in accordance with the demodulations.

8. In a combination as set forth in claim 6, means in the addressed vehicle for demodulating the carrier signals from the pad addressing the vehicle, such signals having the addresses identifying such selective one of the vehicles, and means for operating the drive members in the addressed vehicle in accordance with the demodulated signals.

9. In combination for providing first signals indicating a vehicle to be activated in a plurality of vehicles and indicating functions to be performed in the vehicle, a pad in a plurality, a plurality of switches in the pad, at least a first one of the switches in pad being operable to provide for an addressing of one of the vehicle, second ones of the switches being operable to provide for the performance of the functions in the vehicle, first means for activating the pad, whenever the first switch and the second switches in the pad are operated, to indicate the operation of switches in the pad, second means responsive to the activation of the pad for sending on a wireless basis to the vehicles signals indicating the operation of the first switch and the second switches in the pad, and means in the pad for sending the signals on the wireless basis to the vehicles in a pseudo random pattern with respect to time, the pseudo random pattern for the pad with respect to time being different from the pseudo random pattern of the signals from the other ones of the pads with respect to time.

10. In a combination as set forth in claim 9, the second means in the pad including means for sending on the wireless basis to the vehicles the signals indicating, in a particular sequence and in a binary-coded form, the operation of the first switch and the second switches in the pad.

11. In a combination as set forth in claim 9, the second means in the pad including means for sending to the vehicles the signals indicating, in a particular sequence and in a binary-coded form, the operation of the first switch and the second switches in the pad.

12. In a combination as set forth in claim 9, the second means in the pad including means for sending on the wireless basis to the vehicles the signals indicating, in a particular sequence and in a binary-coded form, the operation of the first switch and the second switches in the pad, the first switch in the pad being operable in a particular number of successive actuations to provide for a selection of the vehicle, and third means for visually indicating the addressing of the vehicle, the second means in the pad including means for sending to the vehicles the signals indicating, in a particular sequence and in a binary-coded form, the operation of the first switch and the second switches in the pad.

13. In combination for providing first signals indicating a vehicle to be activated in a plurality of vehicles and indicating functions to be performed in the vehicle, a pad in a plurality, a plurality of switches in the pad, at least a first one of the switches in pad being operable to provide for an addressing of one of the vehicle, second ones of the switches being operable to provide for the performance of the functions in the vehicle, first means for activating the pad, whenever the first switch and the second switches in the pad are operated, to indicate the operation of switches in the pad, and second means responsive to the activation of the pad for sending on a wireless basis to the vehicles signals indicating the operation of the first switch and the second switches in the pad, means in the pad for sending the signals on the wireless basis to the vehicles in a pseudo random pattern with respect to time, the pseudo random pattern for the pad with respect to time being different from the pseudo random pattern of the signals from the other ones of the pads with respect to time, the first switch in the pad being operable in a particular number of successive actuations to provide for an addressing of the vehicle, and third means for visually indicating in the pad the addressing of the vehicle.

14. In a method of selectively controlling the operation of a plurality of toy vehicles, the steps of:

providing a plurality of pads each having a plurality of controls individually operable to address any one of the vehicles and to select functions to be performed in the addressed vehicle, operating controls in each of the pads to provide the addressing by the pad of one of the vehicles and to obtain a selection of the functions to be performed in the addressed vehicle, and providing for the transmission by each of the pads to the vehicles on a remote and wireless basis of signals addressing one of the vehicles and signals providing for the performance of the functions in the addressed vehicle, providing for the transmission of such signals by each of the pads on a pseudo random basis with respect to time, the pseudo random basis with respect to time of the signals from each pad being different from the pseudo random basis with respect to time of the signals from the other pads, providing in each pad for each of the vehicles an address indicating the vehicle when the vehicle is addressed by the pad, and operating the vehicle in accordance with the operation of the controls in the pad addressing the vehicle and the address of such individual one of the vehicles by the pad selecting such individual one of the vehicles.

15. In a method as set forth in claim 14, the steps of:

receiving at each of the vehicles the signals indicating the address of the vehicle and the functions to be performed in the vehicle, and operating each of the addressed vehicles in accordance with the signals indicating the functions to be performed in the addressed vehicle.

16. In a method as set forth in claim 14, the steps of:

providing in packets at each of the pads the signals indicating the address of the vehicle addressed by the pad and the functions to be performed in the addressed vehicle, and performing in each of the addressed vehicles the functions indicated by the signals in the packets addressed to the vehicle.

17. In a method as set forth in claim 14, the steps of:

providing a plurality of accessories each operative to perform a function, operating a particular one of the controls in each of the pads to address one of the accessories, and providing for the transmission to the accessories of signals for obtaining the operation of one of the accessories when the accessory is selected by one of the pads.

18. In a method as set forth in claim 14, the step of:

providing for the transmission of the signals by each of the pads to the vehicles in a time relationship different from the time relationship of the signals transmitted by the other pads to the vehicles.

19. In a method as set forth in claim 14, the step of:

providing for a release by each of the pads of the vehicle addressed by the pad when the pad fails to address the vehicle for a particular period of time.

20. In a method as set forth in claim 14, the step of:

providing for a release by each of the pads of the vehicle being addressed by the pad when the pad addresses another one of the vehicles.

21. In a method as set forth in claim 15, the step of:

providing carrier signals for each of the pads and modulating on the carrier signals for the pad the signals addressing the vehicle selected by the pad and the signals providing for the performance of the functions by the addressed vehicle.

22. In a method as set forth in claim 14, the steps of:

providing in packets at each of the pads the signals indicating the address one of the vehicles and the functions to be performed in the addressed vehicle, decoding at each of the vehicles the packets of signals transmitted by the pad addressing the vehicle and indicating the functions to be performed by the addressed vehicle, performing in each of the vehicles the functions indicated in the signals in the decoded packets addressed to the vehicle, providing a plurality of accessories each operative to perform a function, operating a particular one of the controls in each of the pads to select one of the accessories, providing for the transmission from each pad to one of the accessories of signals for obtaining the operation of the stationary accessory when the accessory is addressed by the pad, and providing for the transmission of signals from the central station to the vehicles on a wireless basis.

23. In a combination as set forth in claim 22, means in each of the pads for providing for successive transmissions of signals from the pad, in accordance with the operation of the controls in the pad, in a pseudo random pattern of time between the successive transmissions different from the pattern of time between successive transmissions from the other pads.

24. In combination, a plurality of pads disposed in spaced relationship to one another, a plurality of vehicles disposed in spaced relationship to one another and in spaced relationship to the pads, first means in each the pads for sending carrier signals on a wireless basis at a particular frequency to the vehicles and for modulating the carrier signals with addresses identifying the pad and identifying one of the vehicles, a plurality of controls in each of the pads, each of the controls in each of the pads providing upon activation for an operation in the addressed vehicle, first ones of the controls in each of the pads providing for a movement of the addressed vehicle and second ones of the controls in each of the pads providing for an operation of the addressed vehicle other than the movement of the addressed vehicle, second means in each of the pads for providing signals coding the operation of the controls in the pad, third means in each of the pads for transmitting the signals from the pad to the vehicles, fourth means in each of the vehicles for receiving the signals transmitted by the pads on the wireless basis at the particular frequency, fifth means responsive in each of the vehicles to the received signals addressing the vehicle for decoding the signals providing for the operation of the vehicle, and sixth means in each of the vehicles for providing an operation of the first and second ones of the controls in the vehicle in accordance with the signals decoded by the vehicle, means in each of the vehicles for visually indicating the addressing of the vehicle by one of the pads, and means in each of the vehicles for providing for the continued operation of the vehicle by the pad in accordance with signals transmitted to the vehicle by the pad within a particular time interval from the last transmission of signals to the vehicle from the pad.

25. In a combination as set forth in claim 24, the controls in each of the pads providing for a controlled movement of the addressed vehicle in the forward and reverse directions and for a turning of the addressed vehicle, the sixth means in each of the vehicles providing for controlled movements of the vehicle in the forward and reverse directions and for a turning of the vehicle in accordance with the signals decoded by the vehicle.

26. In combination, a plurality of vehicles each having first controls to provide a movement of the vehicle in different directions in accordance with the operation of the first controls and each having members to perform functions other than a movement of the vehicle and each having second controls to obtain the performance of the functions by the members, a plurality of pads each having a plurality of switches controlling the addressing of one of the vehicles and controlling the operation of the members in the addressed vehicle, first means in the pads for sending signals on a wireless basis to the vehicles to address one of the vehicles and to activate the first and second controls in the addressed vehicle, second means responsive in each of the addressed vehicles to the wireless signals from the first means in the pad activating the vehicle for activating the first controls in the addressed vehicle to obtain controlled movements of the addressed vehicle and for activating the members in the addressed vehicle to obtain the performance of the functions by the members, and the first means in the pads sends signals on the wireless basis in a pseudo random pattern with respect to time to the second means in the vehicles and wherein the pseudo random pattern of the signals with respect to time from each of the pads is different from the pseudo random pattern with respect to time of the signals from the other pads.

27. In a combination as set forth in claim 26 wherein the first means in each of the pads provides carrier signals at the same frequency as the first means in the other pads and provides for each of the vehicles a plurality of address signals in a pattern individual to the vehicle and modulates the carrier signals with the address signals to select the vehicle and wherein the second means in each of the vehicles receives the modulated carrier signals from the pads and demodulates the received carrier signals to provide for the activation of the first controls and the members in the vehicle when the demodulated carrier signals indicate that the vehicle has been addressed.

28. In a combination as set forth in claim 27 wherein the first means in each of the pads produces information signals, after the production of the address signals, in accordance with the operation of the switches in the pad and modulates the carrier signals in accordance with the information signals and wherein the second means in each of the addressed vehicles demodulates the modulated signals in the addressed vehicle to obtain the operation of the first controls and the members in the vehicle.

29. In a combination as set forth in claim 28 wherein the second means in each of the pads sends carrier signals on a wireless basis at the same frequency as the carrier signals from the other pads and modulates the carrier signals in accordance with the address of the vehicle selected by the pad and in accordance with the controls operated on the pad and wherein the third means in each of the vehicles demodulates the carrier signals addressed to the vehicle and provides for the operation of the vehicle in accordance with the signals representing the operation of the controls in the pad.

30. In a combination as set forth in claim 29, wherein the second means in each of the pads sends the signals in a pseudo random relationship with respect to time different from the pseudo random relationship with respect to time of the signals sent by the other pads to provide for the reception by the vehicle selected by the pad of the signals addressed by the pad to the vehicle.

31. In combination for providing a controlled operation of a plurality of vehicles;

a plurality of pads each including at least a first control operable to address any one of the vehicles, second controls to provide controlled movements of the addressed vehicle and third controls operable to provide operations of the addressed vehicle other than movements of the vehicle, first means in each of the pads for providing first signals identifying the pad, second signals addressing the vehicle selected by the pad, third signals providing for controlled movements of the addressed vehicle and fourth signals providing for operations of the vehicle other than the movements of the vehicle, second means in each of the pads for transmitting the first, second, third and fourth signals from the pad to the vehicles in the plurality, third means in each of the pads for providing for successive transmissions of the first, second, third and fourth signals by the second means in the pad in a time relationship different from the time relationship for successive transmissions of the first, second, third and fourth signals from the other pads in the plurality, and means in each of the pads for providing an illumination indicating the addressing by the pad of one of the vehicles.

32. In a combination as set forth in claim 31, a plurality of antennas each disposed on one of the pads for transmitting the modulated carrier signals from the pad to the vehicles in the plurality.

33. In a combination as set forth in claim 31, means in each of the pads for providing for the transmission of the first, second, third and fourth signals from each of the pads to the vehicles in the plurality on a wireless basis.

34. In a combination as set forth in claim 31, the first control in each of the vehicles being operative on an iterative basis to address one of the vehicles dependent upon the number of such iterative operations.

35. In a combination as set forth in claim 31, means in each of the vehicles for releasing the vehicle previously addressed by the pad when the pad addresses another of the vehicles in the plurality.

36. In a combination as recited in claim 31 wherein the time relationship for the transmission of the first, second, third and fourth signals from each of the pads is different from the time relationship for the transmission of the first, second, third and fourth signals from the other pads.

37. In a combination as set forth in claim 31, fourth means in each of the pads for providing a carrier signal having the same frequency as the carrier signals provided by the fourth means in the other pads and for modulating the first, second, third and fourth signals from the pad on the carrier signals produced by the fourth means for the pad.

38. In a combination as set forth in claim 37, means in each of the pads for providing for the transmission of the first, second, third and fourth signals from each of the pads to the vehicles on a wireless basis, the first control in each of the vehicles being operative on an iterative basis to address one of the vehicles dependent upon the number of such iterative operations, and means in each of the pads for providing an illumination indicating the addressing by the pad of one of the vehicles.

39. In a combination as set forth in claim 37, means in each of the vehicles for releasing the vehicle previously addressed by the pad when the pad addresses another of the vehicles in the plurality, and the time relationship for the transmission of the first, second, third and fourth signals from each of the pads being different from the time relationship for the transmission of the first, second, third and fourth signals from the other pads.

40. In a combination for providing a controlled operation of a plurality of vehicles, a plurality of pads each including at least a first control operable to address any one of the vehicles and second controls to provide controlled operations of the addressed vehicle, first means responsive in each of the pads to the operation of the first and second controls in the pad for providing packets of signals including first signals identifying the pad, second signals addressing one of the vehicles in the plurality and third signals providing for controlled operations of the addressed vehicle, and second means in each of the pads for transmitting the packets of signals including the first, second and third signals to the vehicles, the second means in each of the pads being operative to transmit the signals from the pad in a pseudo random time pattern different from the pseudo random time pattern of the signals transmitted by the second means in the other pads.

41. In a combination as set forth in claim 40, the second means in each of the pads being operative to transmit the signals from the pad in a pseudo random time pattern different from the pseudo random pattern of the signals transmitted by the second means in the other pads.

42. In a combination as set forth in claim 40 wherein the second means in each of the pads transmits the packets of signals including the first, second and third signals to the vehicles on a wireless basis.

43. In a combination as set forth in claim 40, third means in each of the pads for providing carrier signals and for modulating the first, second and third signals in each packet on the carrier signals.

44. In a combination as set forth in claim 43 wherein the frequency of the carrier signals provided by the third means in each of the pads is the same as the frequency of the carrier signals provided by the third means in the other pads.

45. In a combination as set forth in claim 43, the frequency of the carrier signals provided by the third means in each of the pads being the same as the frequency of the carrier signals from the third means in the other pads, the second means in each of the pads being operative to transmit the signals from the pad in a pseudo random time pattern different from the pseudo random pattern of the signals transmitted by the second means in the other pads, and means for providing a release by each of the pads of the vehicle being addressed by the pad when the pad fails to send for a particular period of time packets of signals including the third signals.

46. In a combination for providing a controlled operation of a plurality of vehicles, a plurality of pads each including at least a first control operable to address any one of the vehicles and second controls to provide controlled operations of the addressed vehicle, first means responsive in each of the pads to the operation of the first and second controls in the pad for providing packets of signals including first signals identifying the pad, second signals addressing one of the vehicles in the plurality and third signals providing for controlled operations of the addressed vehicle, second means in each of the pads for transmitting the packets of signals including the first, second and third signals to the vehicles, and means for providing a release by each of the pads of the vehicle being addressed by the pad when the pad fails to send for a particular period of time packets of signals including the third signals.

47. In a method of selectively controlling the operation of a plurality of toy vehicles, the steps of:

providing a plurality of pads each having a plurality of controls individually operable to address any one of the vehicles and to select functions to be performed in the addressed vehicle, operating controls in each of the pads to provide the addressing by the pad of any one of the vehicles and to obtain a selection of the functions to be performed in the addressed vehicle, providing for the transmission by each of the pads to the vehicles of packets including signals addressing one of the vehicles and including signals providing for the performance of the functions in the addressed vehicle, providing for the reception by the vehicles of the packets of signals transmitted to the vehicles and for the performance in each addressed vehicle of the functions indicated by the packets of signals addressed to the vehicle, and providing for the transmission of the packets of signals from each of the pads in a pseudo random pattern of time different from the pseudo random pattern of time in the packets of signals transmitted from the other pads.

48. In a method as set forth in claim 47, the step of:

providing for a release by each of the pads of the vehicle being addressed by the pad when the pad sends packets of signals including signals addressing another one of the vehicles.

49. In a method as set forth in claim 47, the step of:

providing for a release by each of the pads of the vehicle being addressed by the pad when the pad sends packets of signals including signals addressing another one of the vehicles, providing for a release by each of the pads of the vehicle being addressed by the pad when the pad fails to send for a particular period of time packets of signals including signals providing for the performance of the functions in the vehicle being addressed by the pad, and providing carrier signals for each of the pads and modulating on the carrier signals for the pad the signals in the packets transmitted by the pad including the signals addressing one of the vehicles and the signals providing for the performance of the functions in the addressed vehicle.

50. In a method as set forth in claim 47 wherein the signals are transmitted by the pads to the vehicles on a wireless basis and wherein the packets of the signals transmitted by the pads to the vehicles on the wireless basis are received by the vehicles and provide for the performance in each vehicle of the functions indicated by the packets of signals addressed to the vehicle.

51. In a method of selectively controlling the operation of a plurality of toy vehicles, the steps of:

providing a plurality of pads each having a plurality of controls individually operable to address any one of the vehicles and to select functions to be performed in the addressed vehicle operating controls in each of the pads to provide the addressing by the pad of any one of the vehicles and to obtain a selection of the functions to be performed in the addressed vehicle providing for the transmission by each of the pads to the vehicles of packets including signals addressing one of the vehicles and including signals providing for the performance of the functions in the addressed vehicle, providing for the reception by the vehicles of the packets of signals transmitted to the vehicles and for the performance in each addressed vehicle of the functions indicated by the packets of signals addressed to the vehicle, and providing for a release by each of the pads of the vehicle being addressed by the pad when the pad fails to send for a particular period of time packets of signals including the signals providing for the performance of the functions in the vehicle being addressed by the pad.

52. In a method as set forth in claim 51, the step of:

providing carrier signals for each of the pads and modulating on the carrier signals for the pad the signals in the packets transmitted by the pad including the signals addressing one of the vehicles and the signals providing for the performance of the functions in the vehicle.

53. In combination for providing a controlled operation of a plurality of vehicles, a plurality of pads each including controls operable to address any one of the vehicles and to provide controlled movements of the addressed vehicle, first means responsive in each of the pads to the operation of the controls in the pad for providing packets of signals including first signals identifying the pad, second signals addressing one of the vehicles in the plurality and third signals providing for controlled movements of the addressed vehicle, and second means in each of the pads for transmitting the packets of signals in the pads, including the first, second and third signals, to the vehicles, the second means in each of the pads being operative to transmit the signals to the vehicles in a time pattern different from the time pattern for the transmission of the signals from the second means in the other pads to the vehicles, wherein the different time pattern of the signals from the second means in each of the pads results from the transmission of the signals from the second means in the pad to the vehicles on a pseudo random basis different from the pseudo random basis of the signals transmitted from the second means in the other pads.

54. In a combination as set forth in claim 53, including, third means in each of the pads for providing carrier signals and for modulating on the carrier signals the first, second and third signals in each packet from the pad.

55. In a combination as set forth in claim 53, third means in each of the pads for providing carrier signals and for modulating on the carrier signals the first, second and third signals in each packet from the pad.

the frequency of the carrier signals provided by the third means in each of the pads being the same as the frequency of the carrier signals provided by the third means in the other pads.

56. In combination, a plurality of pads displaced from one another, each of the pads having a plurality of controls, each of the pads being operative to produce sets of address signals, a plurality of vehicles displaced from one another and displaced from the pads, each of the vehicles being responsive to the address signals from any one of the pads to be controlled thereafter in its operation in accordance with the operation of controls from the addressing pad, first means in each of the pads for providing for the selection of any one of the vehicles and for providing for a controlled operation of the selected vehicle in accordance with the operation of the controls in the pad, second means in each of the pads for sending directly to the vehicles address signals and control signals indicating the operation of the controls in the pad, to obtain an operation of the addressed vehicle in accordance with the operation of the controls in the pad, third means in each of the vehicles for activating the vehicle in accordance with the reception of the signals representing the address for the vehicle and for providing for an operation of the vehicle in accordance with the control signals received by the vehicle from the pad addressing the vehicle, and wherein the third means in each of the vehicles releases the vehicle from control by the pad addressing the vehicle when the third means in the vehicle does not receive signals addressed to the vehicle by the second means in the pad for at least a particular period of time.

57. In a combination as set forth in claim 56, wherein the second means in each pads sends the signals in a time relationship different from the time relationship of the signals sent by the other pads to provide for the activation of the vehicle addressed by the pad.

58. In a combination as set forth in claim 56, wherein the third means in each of the vehicles provides for a continued operation of the vehicles, in accordance with the previous operation of the vehicles for a particular period of time after the previous operation of the vehicle without any further addressing operation of the vehicle by the pad.

* * * * *

UNITED STATES PATENT AND TRADEMARK OFFICE

CERTIFICATE OF CORRECTION

PATENT NO. 5,885,159

DATED Mar. 23, 1999

INVENTOR(S) Peter C. DeAngelis

It is certified that error appears in the above-identified patent and that said Letters Patent is hereby corrected as shown below:

Title page in the ABSTRACT, line 15 of text, after "address", add --of--.

Column 11, claim 1, line 51, after "the", add --vehicle--.

Column 12, claim 4, line 23, change "lads", to --pads--.

Column 12, claim 6, line 64, delete "the", 2nd occurrence.

Column 13, claim 7, line 3, delete "the", 2nd occurrence.

Column 15, claim 21, line 1, change "15", to --14--.

Column 15, claim 22, line 49, delete "stationary".

Column 15, claim 23, line 59, after "between", add --the--.

Column 15, claim 24, line 66, after "each", add --of--.

UNITED STATES PATENT AND TRADEMARK OFFICE

CERTIFICATE OF CORRECTION

PATENT NO. : 5,885,159

DATED : Mar. 23, 1999

INVENTOR(S) : Peter C. DeAngelis

It is certified that error appears in the above-identified patent and that said Letters Patent is hereby corrected as shown below:

Column 20, claim 50, line 41, change "47", to --51--.

Column 22, claim 58, line 46, after "vehicle", add --,--.

Signed and Sealed this

Second Day of May, 2000

*Attest:*

*Attesting Officer*

Q. TODD DICKINSON

*Director of Patents and Trademarks*